US008069934B2

(12) United States Patent
Yatsenko et al.

(10) Patent No.: US 8,069,934 B2
(45) Date of Patent: Dec. 6, 2011

(54) DRILL BITS FOR DRILLING WELLS

(76) Inventors: Yuriy Yatsenko, Brooklyn, NY (US); Boris Avramchuk, Philadelphia, PA (US); Siarhei Zmitkovich, Philadelphia, PA (US)

( * ) Notice: Subject to any disclaimer, the term of this patent is extended or adjusted under 35 U.S.C. 154(b) by 281 days.

(21) Appl. No.: 12/454,987

(22) Filed: May 27, 2009

(65) Prior Publication Data

US 2010/0300762 A1 Dec. 2, 2010

(51) Int. Cl.
*E21B 10/24* (2006.01)

(52) U.S. Cl. ..... 175/228

(58) Field of Classification Search ..... 175/227, 175/228, 229; 384/93
See application file for complete search history.

(56) References Cited

U.S. PATENT DOCUMENTS 1,136,134 A * 4/1915 Hughes ..... 175/228
1,551,366 A * 8/1925 Carlson ..... 384/93
1,708,288 A * 4/1929 Wadsworth ..... 175/353
3,007,750 A * 11/1961 Cunningham ..... 384/466
3,029,881 A * 4/1962 Swart ..... 175/228
3,048,230 A * 8/1962 Angel ..... 175/228
4,335,791 A * 6/1982 Evans ..... 175/228

* cited by examiner

*Primary Examiner* — David Bagnell
*Assistant Examiner* — David Andrews
(74) *Attorney, Agent, or Firm* — Aleksandr Smushkovich

(57) ABSTRACT

A device including a drill bit is disclosed. The bit preferably comprises lug members, joined by a support member, each lug member includes a through hole, bearings rotatably mounted on the lug members which bearings support cutter members, a sleeve with lubricant mounted upon the support member, a central channel within the sleeve whose lower end can be closed or opened with a reciprocating valve-plate, an annular piston snug-fitting between the sidewalls of sleeve and central channel, which piston has a discharge valve outletting the lubricant through the piston, a spring disposed in the sleeve, rods mounted in the sleeve and inserted through the holes, lubrication channels arranged in the lug members and communicating the lower portion of sleeve with the bearings for lubrication thereof. The rods are coupled to the piston and the valve-plate. Embodiments include shafts supporting the bearings. Some shafts are hollow and have a coolant system.

4 Claims, 5 Drawing Sheets

DRILL BITS FOR DRILLING WELLS

TECHNICAL FIELD

The invention relates to bore or drilling devices utilized in the oil and gas extracting industries, in the water supply industry, etc., specifically to downhole drill bits deployed for the fast drilling of deep wells.

BACKGROUND OF THE INVENTION

There are known many different tools and devices for drilling oil, gas, and water wells. A traditional device is usually composed of a bore string consisting of a plurality of tubular pipes driven by a power unit typically located on the surface. The power unit provides rotation of the pipes in turn revolving a drill bit that actually performs the drilling. Typically, lubrication of such drill bits is provided during the assembling process at manufacturer's facilities. In practice this lubrication is insufficient for durable exploitation of the bits that leads to their overheating and failure, and consequently to changing the bit for a new one that is very costly.

There have been proposed some devices to improve lubrication of the bits. An example of such drill bit is taught in U.S. Pat. No. 4,381,824: "In a non-sealed rolling cutter drill bit having at least one bearing journal shaft and a rolling cutter rotatably mounted on the shaft and having at least one flat interior end face in rotary bearing contact with the end of said bearing journal shaft to support end thrust loads, the improvement comprising: at least one lubricant rod slidably mounted in said shaft for longitudinal movement therein and arranged to contact said flat interior end face of said rolling cutter; and, biasing means associated with said lubricating rod and arranged to urge said rod against said flat interior end face during rotation of said rolling cutter to lubricate the end thrust bearing surfaces thereof."

A drawback of such a device is that the lubricant rod relatively quickly wears out, and the bit continues rotation essentially without lubrication. This involves either failure, or destruction of the bit, or significant expenses for frequent replacements of the lubricant rod.

SUMMARY OF THE INVENTION

Therefore, the primary aim of the present invention is to provide efficient drill bits for speedy drilling deep boreholes for mining and other industries, which bits should be provided with improved lubrication and cooling means, and also should be preferably re-assembleable to extend the operation term of their basic parts. In some preferred embodiments, the inventive bit should also allow drilling the boreholes without rotation of the bore string that significantly reduces operation and maintenance costs of drilling installations. Other aims of the invention might become apparent to a skilled artisan upon learning the present disclosure.

The mentioned aims are achieved by providing three versions of preferred embodiments of the inventive drill bits, as well as optional embodiments thereof.

In a first version, the drill bit comprises: three lug members preferably arranged at a 120 degree angle to each other and joined by an upper support member (preferably a rim) preferably having an outer screw threading substantially for connection to the lower pipe of the bore string or for connection to an intermediate member therebetween, each lug member includes a lower journal portion and has a through vertical hole in the upper portion; three bearings each externally and rotatably mounted on the journal portion of each lug member, the bearings each fixedly supports a cutter member having a shape similar to a truncated cone (further called a 'conical' cutter member), whose longitudinal axe is positioned at a predetermined tilt angle to the horizon, the cutter member has a predetermined number of cutting elements (preferably made of suitable high-strength alloys) mounted on the external surface of the cutter member; an essentially vertically disposed sleeve having a base mounted upon the upper support member and having an aperture on top for input of lubrication liquid; a tubular channel centrally disposed within the sleeve, the tubular channel includes a lower portion outstanding below the sleeve's base and terminated with an opening that is controllably closed or opened with a vertically reciprocating bottom valve-plate; an annular flat washer-shaped piston capable to vertically reciprocate in the bottom region of the sleeve, snug-fitting between the sidewalls of the sleeve and the tubular channel, the piston is furnished with at least one discharge valve outletting the lubrication liquid downward through the piston at a predetermined reverse pressure; a spring disposed at the bottom of the sleeve below the piston; three rods mounted in the bottom region of the sleeve and inserted through the aforesaid holes of lug members, the upper ends of the rods are coupled to the annular piston, and the lower ends of the rods are coupled to the valve-plate; and lubrication channels arranged in the lug members, and communicating the bottom region of the sleeve under the piston with the bearings of cutter members. In alternative embodiments, the inventive drill bit of the first version can comprise a predetermined number 'N' of lug members preferably arranged at a 360/N degree angle in relation to each other.

In a second version, the drill bit comprises: three lug members preferably arranged at a 120 degrees to each other and joined by an upper support member (preferably a rim) preferably having an outer screw threading (optionally, other connection means can be employed) substantially for connection to the lower pipe of the bore string or to an intermediate member between the lower pipe and the upper support member, and having a through vertical hole in the upper portion; three shafts, disposed preferably horizontally, each shaft is immovably bolted through a C-shaped bracket to the lower portion of each lug member, the shafts are fixedly coupled to each other collectively forming a 'three-beam star', each shaft has a number of surface axial grooves for supplying lubricant; three inner and three outer conical cutter members, each individually fixedly coupled to a roll bearing rotatably mounted on the corresponding shaft of each lug member, each cutting member has a predetermined number of cutting elements (preferably made of suitable high-strength alloys) mounted on the external surface of the cutter member; an essentially vertically disposed sleeve having a base mounted upon the upper support member and an aperture on top for input of lubrication liquid; a tubular channel centrally disposed within the sleeve, the tubular channel includes a lower portion outstanding below the sleeve's base, and terminated with an opening that is controllably closed or opened with a vertically reciprocating bottom valve-plate; an annular flat washer-shaped piston capable to vertically reciprocate in the bottom region of the sleeve, snug-fitting between the sidewalls of the sleeve and the tubular channel, the piston is furnished with at least one discharge valve outletting the lubrication liquid downward through the piston at a predetermined reverse pressure; a spring disposed at the bottom of the sleeve below the piston; three rods mounted in the bottom region of the sleeve and sealably inserted through the aforesaid holes of lug members, the upper ends of the rods are coupled to the piston, and the lower ends of the rods are coupled to the valve-plate; and lubrication channels arranged in the lug members, communicating the bottom region of the sleeve under the piston with the inner and outer roll bearings of cutter members. In alternative embodiments, the inventive drill bit of the second version can comprise a predetermined number 'N' of lug members preferably arranged at a 360/N degree angle in relation to each other and N corresponding shafts.

In a third version, the drill bit comprises: three lug members preferably arranged at a 120 degrees to each other and joined by an upper support member (preferably a rim) preferably having an outer screw threading (optionally, other connection means can be employed) substantially for connection to the lower pipe of the bore string or to an intermediate member between the lower string pipe and the upper support member, each lug member has a through vertical hole in the upper portion thereof, three shafts, disposed preferably horizontally, each shaft is immovably bolted through a C-shaped bracket to the lower portion of each lug member and fixedly coupled to each other collectively forming a 'three-beam star', each shaft has a number of axial grooves for supplying lubricant, the shafts each has an internal through shaft channel, which shaft channels communicate through the hub of the 'three-beam star'; three inner, three intermediate, and three outer conical cutter members, each individually fixedly coupled to a roll bearing rotatably mounted on the corresponding shaft of each lug member, each cutting member has a predetermined number of cutting elements (preferably made of suitable high strength alloys) mounted on the external surface of the cutter member; an essentially vertically disposed sleeve having a base mounted to the upper support member and an aperture on its top for input of lubrication liquid; a tubular channel centrally disposed within the sleeve, the tubular channel includes a lower portion outstanding below the sleeve's base, and terminated with an opening that is controllably closed or opened with a vertically reciprocating bottom valve-plate; an annular flat washer-shaped piston capable to vertically reciprocate in the bottom region of the sleeve, snug-fitting between the sidewalls of the sleeve and the tubular channel, the annular piston is furnished with at least one discharge valve outletting the lubrication liquid downward through the piston at a predetermined reverse pressure; a spring disposed at the bottom of the sleeve below the annular piston; three cooling vessels in the form of cylinders (optionally another shape can be used if necessary) filled with suitable coolant (preferably, liquid nitrogen) mounted on each lug member immediately below the sleeve's bottom, the cooling cylinders are communicated via the aforementioned shaft internal channels and via return channels suitably arranged therebetween, one of the cooling cylinders has a circular piston snug-fitting into and capable to reciprocate within the cooling cylinder; three rods mounted in the bottom region of the sleeve and sealably inserted through the aforesaid holes of lug members and trough, the cooling cylinders, the upper ends of the rods are coupled to the lubrication annular piston, and the lower ends of the rods are coupled to the valve-plate, one of the rods is coupled with the circular piston of the corresponding cooling cylinder; and lubrication channels arranged in the lug members, and communicating the bottom region of the sleeve under the annular piston with the inner, intermediate, and outer roll bearings of cutter members. In alternative embodiments, the inventive drill bit of the third version can comprise a predetermined number 'N' of the lug members preferably arranged at a 360/N degree angle in relation to each other, and N corresponding shafts.

In each version of the inventive drill bit, the sleeve is filled with lubrication (lubricant) liquid (preferably suitable oil), whereas the tubular channel is preferably connected to a conventional operating fluid system utilized for washing up solid earth pieces and particles resulted from the drilling and removing them from the borehole onto the surface. The operating fluid can be pumped by a suitable pump, whose power can preferably be controlled.

A 'Turbo-Gear for Speedy Drilling Wells' was proposed by the instant applicant in a U.S. patent application Ser. No. 12/291,239 filed on Nov. 7, 2008, published as US2010/0116554, hereby entirely incorporated by reference, which might essentially reduce expenses for drilling wells or boreholes. On the other hand, the turbo-gear can only operate in conjunction with a drill bit that actually performs the drilling. Some preferred embodiments of the instant invention are best suitable for combining with the mentioned turbo-gear, though may find useful applications in combination with other devices (including traditional drilling equipment) provided for the same or similar purpose.

Figure 1:
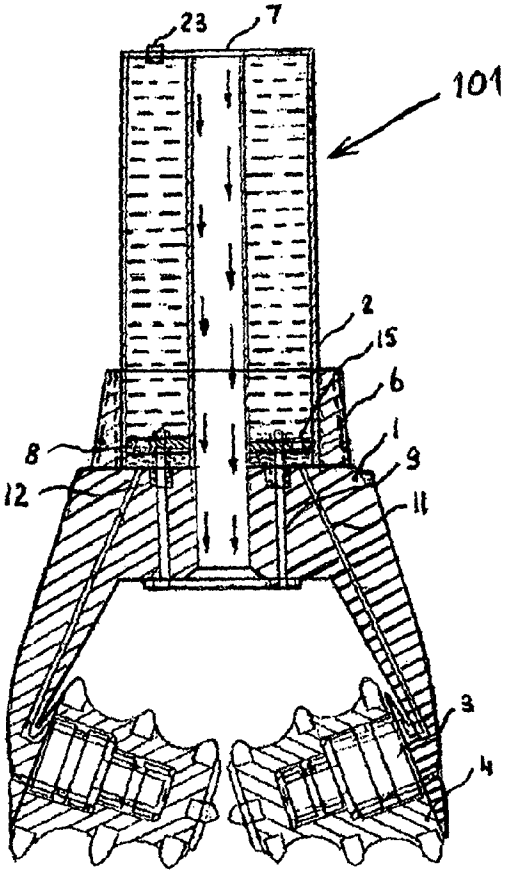
FIG. 1 is a sectional view of a drill bit of a first version, according to a preferred embodiment of the invention.

Each reference numeral indicated on FIGS. 1-5 is designated to an element of the inventive structures described herein below. Identical elements of different embodiments are generally designated with the same reference numerals. A first time introduced element in the description has a reference numeral that is enclosed into parentheses.

DETAIL DESCRIPTION OF PREFERRED EMBODIMENTS OF THE INVENTION

While the invention may be susceptible to embodiment in different forms, there is shown in the drawing, and will be described in detail herein, a specific embodiment of the present invention, with the understanding that the present disclosure is to be considered an exemplification of the principles of the invention, and is not intended to limit the invention to that as illustrated and described herein.

First Version of Inventive Drill Bit

Figure 4:
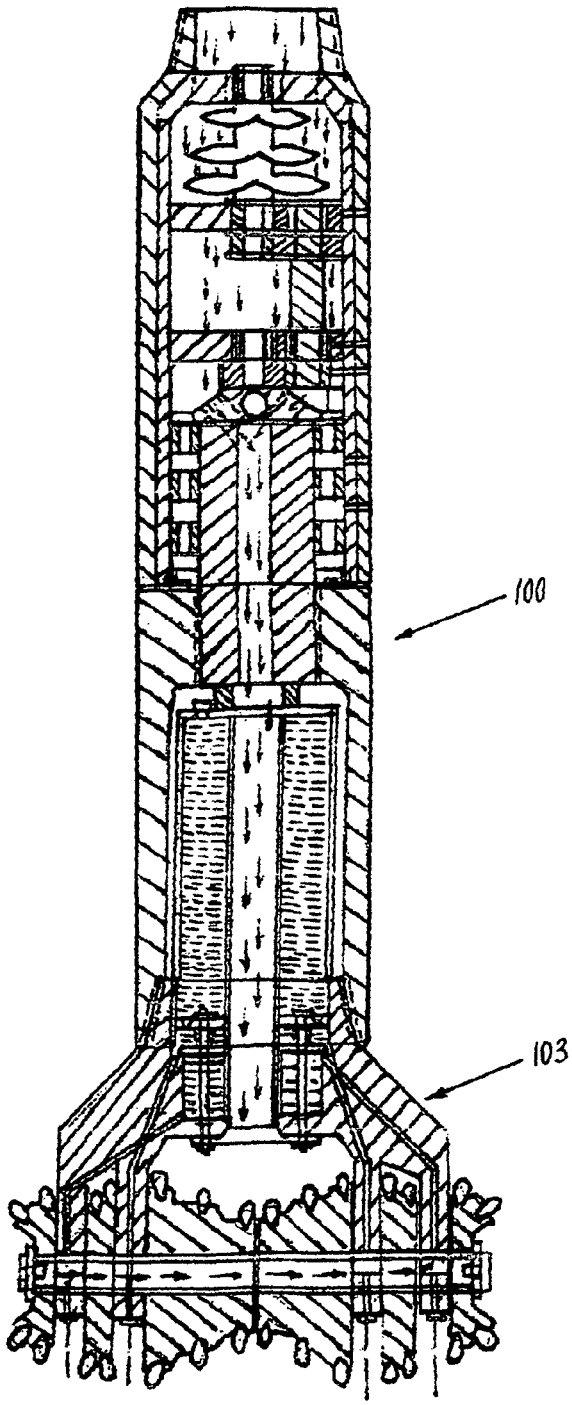
FIG. 4 is a sectional view of a drill bit in the third version in combination with the turbo-gear, according to a preferred embodiment of the invention and to U.S. patent application Ser. No. 12/291,239 of the instant applicant.

In a preferred embodiment illustrated on FIG. 1, an inventive drill bit (101) comprises: three lug members (1) arranged at a 120 degree angle to each other and joined by an upper support member (6) of an annular shape, preferably having an outer screw threading substantially for connection to the lower pipe of the bore string (not shown) or for connection to an intermediate member therebetween, e.g. a turbo-gear (100) shown on FIG. 4 (according to the aforementioned U.S. patent application Ser. No. 12/291,239). Each lug member 1 includes a lower journal portion and has a through vertical hole in the upper portion.

The drill bit 101 comprises three bearings (3); each bearing 3 is externally and rotatably mounted on the journal portion of each lug member 1; each bearing 3 fixedly supports a conical cutter member (4), whose longitudinal axe is positioned at a predetermined tilt angle to the horizon. The cutter member 4 has a predetermined number of cutting elements mounted on the external surface thereof.

The drill bit 101 comprises an essentially vertically disposed sleeve (2) having a base mounted upon the upper support member 6, and having an aperture (23) on top of the sleeve 2, for input of lubrication liquid.

The drill bit 101 comprises a tubular channel (7) centrally disposed within the sleeve 2, the tubular channel 7 includes a lower portion outstanding below the sleeve's base and terminated with an opening that is controllably closed or opened with a vertically reciprocating bottom valve-plate (10). The tubular channel 7 is supplied with a pressurized flow of operating fluid from the aforementioned operating fluid system (not illustrated).

The drill bit 101 comprises an annular flat washer-shaped piston (8) capable to vertically reciprocate in the bottom region of the sleeve 2, snug-fitting between the sidewalls of the sleeve 2 and the tubular channel 7. The piston 8 is furnished with at least one discharge valve (15) controllably outletting the lubrication liquid through the piston 8.

The drill bit 101 comprises a spring (12), disposed at the bottom of the sleeve 2 below the annular piston 8, and three rods (9) mounted in the bottom region of the sleeve 2 and inserted through the aforesaid holes of lug members 1. The upper ends of the rods 9 are coupled to the annular piston 8, and the lower ends of the rods are coupled to the valve-plate 10.

The drill bit 101 comprises lubrication channels (11) arranged in the lug members 1, and communicating the bottom region of the sleeve 2 under the piston 8 with the bearings 3 of cutter members 4.

The inventive drill bit 101 operates in the following manner: at an operator's command, the operating fluid system activates a pump (not shown) that develops a predetermined pressure in the fluid system. Since the channel 7 is connected to the fluid system, the valve-plate 10 is urged by the pressure downward. The valve-plate 10 pulls down the rods 9 with the piston 8 overcoming forces created by the spring 12, and supplying a dose of lubricant liquid into the bearings 3. When the operator commands to stop drilling, the system stops supplying doses of the operating fluid, this reduces the pressure of lubricant liquid, downwardly applied to the valve-plate 10, and the piston 8 returns upward to its initial position pulled up by the forces of spring 12. The discharge valve 15 outlets the lubrication liquid downward through the piston 8 at a predetermined reverse pressure, until the pressures above and under the piston 8 will be equalized.

The drill bit 101 has a preferable diameter of 220 mm. It should be advantageously used for boreholes not exceeding 5 Km.

Second Version of Inventive Drill Bit

Figure 2:
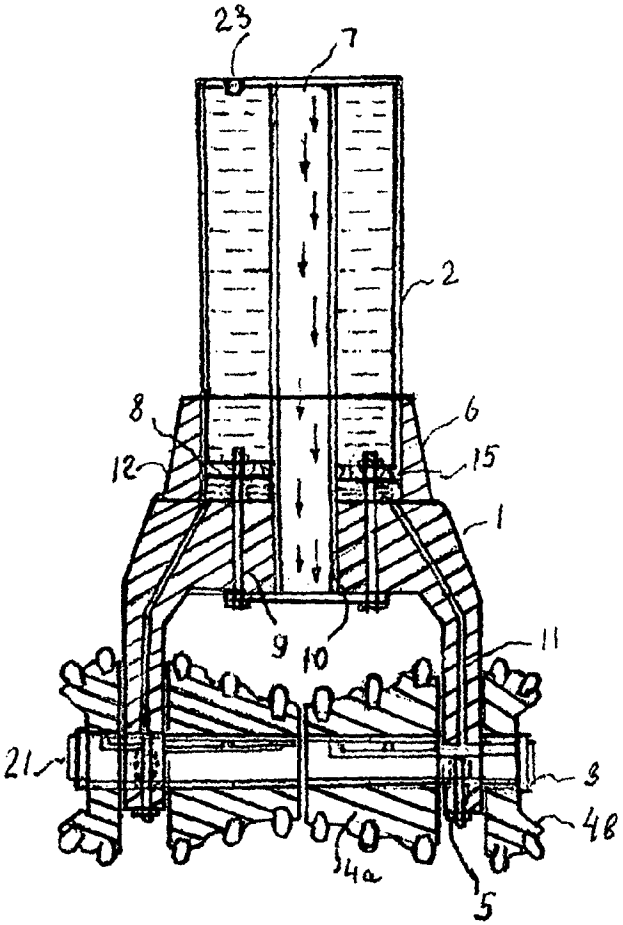
FIG. 2 is a sectional view of a drill bit of a second version, according to a preferred embodiment of the invention.

As illustrated on FIG. 2, in a second version, a drill bit (102) comprises: three lug members (1) preferably arranged at a 120 degrees to each other and joined by an upper support member (6) preferably having an outer screw threading (optionally, other connection means can be employed) substantially for connection to the lower pipe of the bore string (not shown) or to an intermediate member between the lower pipe and the upper support member 6 (e.g. the turbo-gear 100 shown on FIG. 4, according to the aforementioned U.S. patent application Ser. No. 12/291,239). Each lug member 1 has a through vertical hole in the upper portion thereof.

The drill bit 102 comprises three shafts (20), (21) (shown on FIG. 2), and a third shaft (not seen on FIG. 2). The three shafts are disposed, preferably horizontally; each shaft is immovably bolted to a 'C'-shaped bracket (5). The brackets 5 each is fixed to the lower portion of corresponding lug member 1, so that the gap of the 'C' is positioned on top. The shafts are fixedly connected to each other in a central hub, collectively forming a 'three-beam star'. Each shaft has a number of surface axial grooves for supplying lubricant liquid.

The drill bit 102 comprises three inner (4*a*) and three outer (4*b*) conical cutter members, each individually fixedly coupled to a roll bearing (3) rotatably mounted on the corresponding shaft of each lug member 1. Each pair of cutting member 4*a* or 4*b* is situated on one of the shafts. Each cutting member 4*a* or 4*b* has a predetermined number of cutting elements (preferably made of suitable high-strength alloys) mounted on the external surface of the cutter member.

The drill bit 102 comprises an essentially vertically disposed sleeve (2) having a base mounted upon the upper support member 6, and an aperture (23) on top for input of lubrication liquid.

The drill bit 102 comprises a tubular channel (7) centrally disposed within the sleeve 2. The tubular channel 7 includes a lower portion outstanding below the sleeve's base, and terminated with an opening that is controllably closed or opened with a vertically reciprocating bottom valve-plate (10).

The drill bit 102 comprises an annular flat washer-shaped piston (8) capable to vertically reciprocate in the bottom region of the sleeve, snug-fitting between the sidewalls of the sleeve 2 and the tubular channel 7. The piston 8 is furnished with at least one discharge valve (15), outletting the lubrication liquid downward through the piston 8 at a predetermined reverse pressure.

The drill bit 102 comprises a spring (12) disposed at the bottom of the sleeve 2 below the piston 8, and three rods (9) mounted in the bottom region of the sleeve and sealably inserted through the aforesaid holes of lug members 1. The upper ends of the rods 9 are coupled to the piston 8, and the lower ends of the rods 9 are coupled to the valve-plate 10.

The drill bit 102 comprises lubrication channels (11) arranged in the lug members 1, communicating the bottom region of the sleeve 2 under the piston with the inner and outer roll bearings 3 of cutter members 4.

The inventive drill bit 102 operates in the following manner: at an operator's command, the operating fluid system activates a pump (not shown) that develops a predetermined pressure in the fluid system. Since the channel 7 is connected to the fluid system, the valve-plate 10 is urged by the pressure downward. The valve-plate 10 pulls down the rods 9 with the piston 8 overcoming forces created by the spring 12, and supplying a dose of lubricant liquid into the bearings 3. When the operator commands to stop drilling, the system stops supplying doses of the operating fluid, this reduces the pressure of lubricant liquid, downwardly applied to the valve-plate 10, and the piston 8 returns upward to its initial position pulled up by the forces of spring 12. The discharge valve 15 outlets the lubrication liquid downward through the piston 8 at a predetermined reverse pressure, until the pressures above and under the piston 8 will be equalized.

The drill bit 102 has a preferable diameter of 350 mm of the lower part thereof. It should be advantageously used for boreholes not exceeding 7 Km. The drill bit 102 is differed from the drill bit 101 in that the drill bit 102 of the second version can be dissembled, when necessary, by releasing the bolts of the 'C'-shaped bracket 5, taking out the shafts with the cutter members 4*a* and 4*b*, inserting new shafts with new cutter members 4*a* and 4*b*, securing them by the bolts, and thereby re-assembling the bit 102. This allows continuing exploitation of the upper part of bit 102 that significantly saves money comparatively to the bit 101.

Third Version of Inventive Drill Bit

Figure 3:
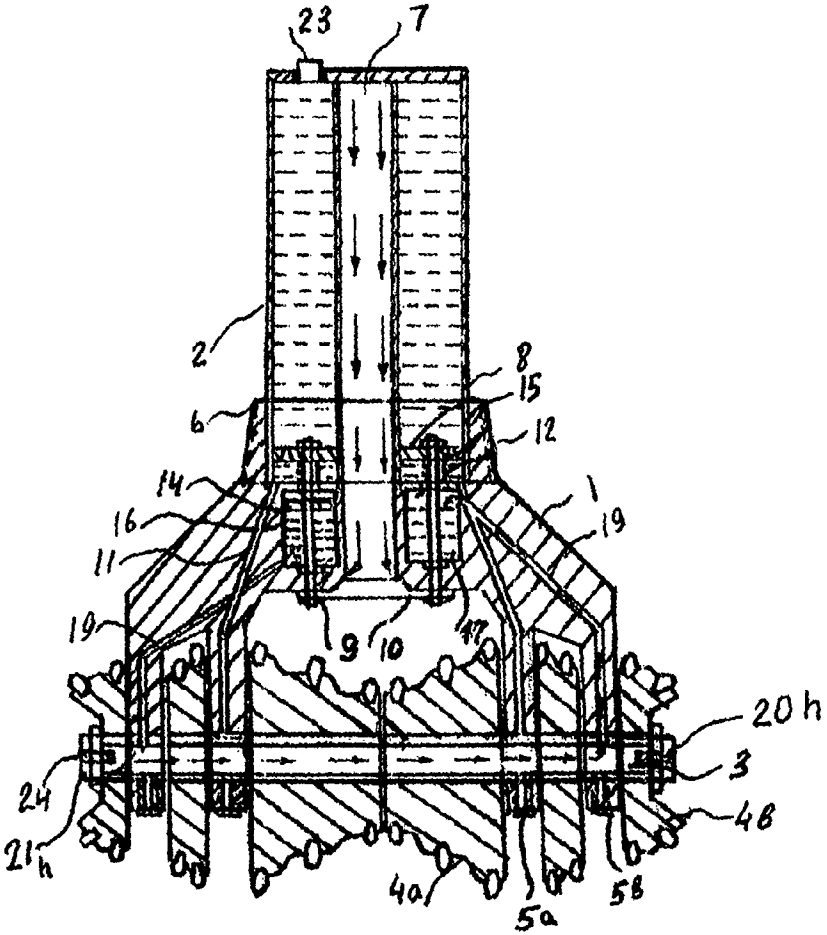
FIG. 3 is a sectional view of a drill bit of a third version, according to a preferred embodiment of the invention.
Figure 5:
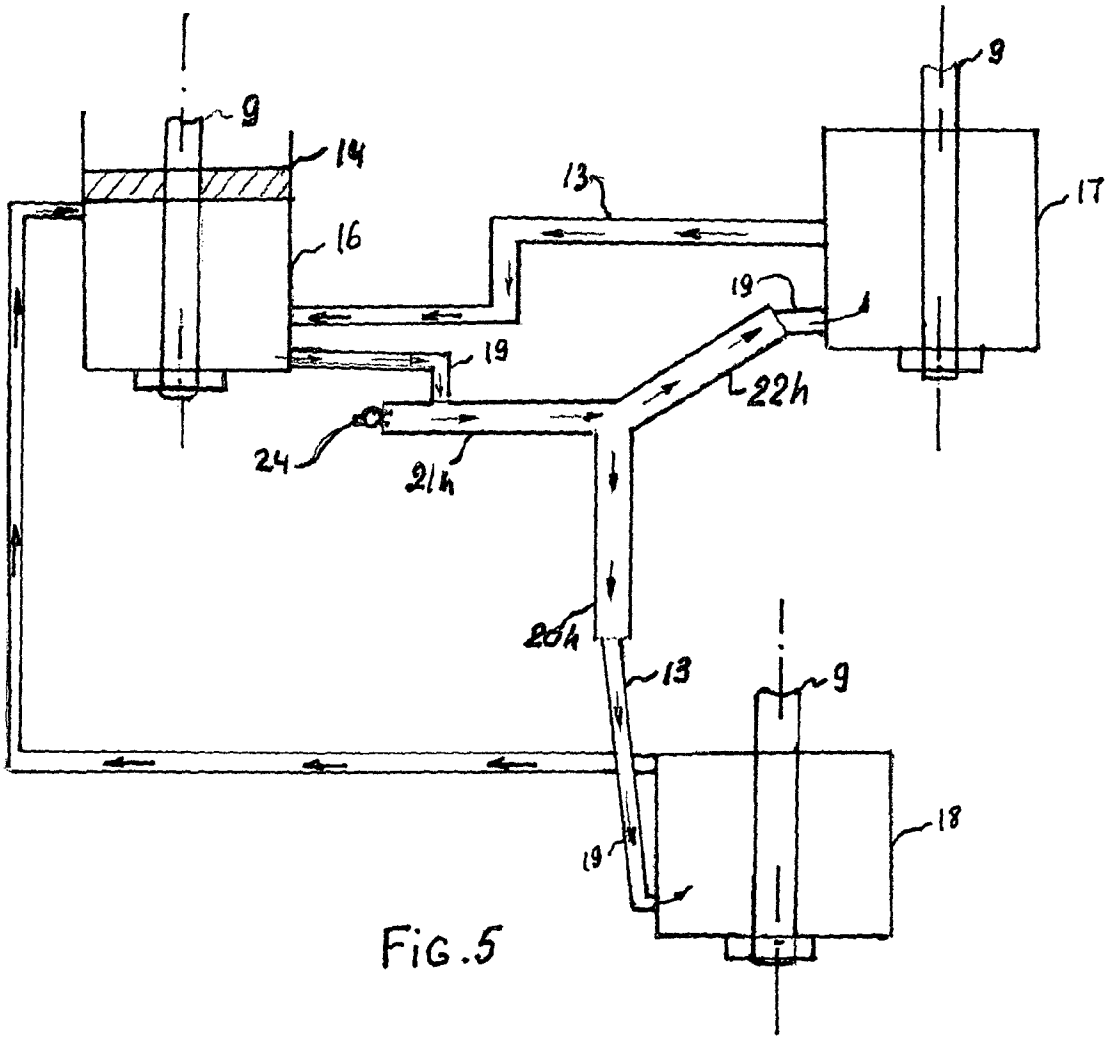
FIG. 5 is a schematic view of coolant circulation in the third version drill bit, according to a preferred embodiment of the invention.

In a third version, a drill bit (103), shown on FIG. 3, and partially on FIG. 5, comprises: three lug members (1) preferably arranged at a 120 degrees to each other and joined by an upper support member (6) preferably having an outer screw threading substantially for connection to the lower pipe of the bore string (not shown) or to an intermediate member between the lower string pipe and the upper support member 6 (e.g. the turbo-gear 100 shown on FIG. 4, according to the aforementioned U.S. patent application Ser. No. 12/291,239). Each lug member 1 has a through vertical hole in the upper portion thereof.

The drill bit 103 comprises three hollow shafts: (20*h*), (21*h*), shown on FIGS. 3 and 5, and a shaft (22*h*), shown on FIG. 5. The three shafts are disposed, preferably horizontally; each shaft is immovably bolted to a 'C'-shaped bracket (5*a*) and (5*b*). The brackets 5*a* and 5*b* each is fixed to the lower portion of corresponding lug member 1, so that the gap of the 'C' is positioned on top. The shafts are fixedly connected to each other in a central hub, collectively forming a 'three-beam star'. Each shaft has a number of surface axial grooves for supplying lubricant liquid. The shafts each has an internal through shaft channel, which shaft channels communicate through the hub of the 'three-beam star', as shown on FIG. 5.

As depicted on FIG. 3, the drill bit 103 comprises three inner (4*a*), three intermediate (4*c*), and three outer (4*b*) conical cutter members, each individually fixedly coupled to a roll bearing 3 rotatably mounted on the corresponding shaft of each lug member 1. Each cutting member has a predetermined number of cutting elements (preferably made of suitable high strength alloys) mounted on the external surface of the cutter member.

The drill bit 103 comprises an essentially vertically disposed sleeve (2) having a base mounted to the upper support member 6 and an aperture (23) on its top for input of lubrication liquid.

The drill bit 103 comprises a tubular channel (7) centrally disposed within the sleeve 2. The tubular channel 7 includes a lower portion outstanding below the sleeve's base, and terminated with an opening that is controllably closed or opened with a vertically reciprocating bottom valve-plate (10).

The drill bit 103 comprises an annular flat washer-shaped piston (8) capable to vertically reciprocate in the bottom region of the sleeve, snug-fitting between the sidewalls of the sleeve 2 and the tubular channel 7.

The annular piston 8 is furnished with at least one discharge valve (15) outletting the lubrication liquid downward through the piston at a predetermined reverse pressure.

The drill bit 103 comprises a spring disposed at the bottom of the sleeve 2 below the annular piston 8.

The drill bit 103 comprises three cooling cylinders (16), (17) shown on FIGS. 3 and 5, and (18) shown on FIG. 5. The cooling cylinders are filled with suitable coolant (preferably, liquid nitrogen), and mounted on each lug member 1 immediately below the sleeve's bottom. The cooling cylinders are communicated with the internal channels of shafts 20*h*, 21*h*, and 22*h* via supply channels (19) shown on FIGS. 3 and 5, and via return channels (13) shown on FIG. 5 suitably arranged between the cooling cylinders. An input aperture (24) is arranged at an end of one of the cylinders, e.g. on the cylinder 21*h*, as depicted on FIGS. 3 and 5 for inlet of the coolant. The cooling cylinder 16 has a circular piston (14) snug-fitting into and capable to reciprocate within the cooling cylinder.

The drill bit 103 comprises three rods (9) mounted in the bottom region of the sleeve 2, and sealably inserted through the aforesaid holes of lug members 1 and trough the cooling cylinders. The upper ends of the rods 9 are coupled to the lubrication annular piston 8, whereas the lower ends of the rods 9 are coupled to the valve-plate 10. One of the rods 9 is coupled with the circular piston of the cooling cylinder 16.

The drill bit 103 comprises lubrication channels (11) arranged in the lug members 1, and communicating the bottom region of the sleeve 2 under the annular piston 8 with the inner, intermediate, and outer roll bearings 3 of the respective cutter members 4*a*, 4*c*, and 4*b*.

The inventive drill bit 103 operates in the following manner: at an operator's command, the operating fluid system activates a pump (not shown) that develops a predetermined pressure in the fluid system. Since the channel 7 is connected to the fluid system, the valve-plate 10 is urged by the pressure downward. The valve-plate 10 pulls down the rods 9 with the piston 8 overcoming forces created by the spring 12, and supplying a dose of lubricant liquid into the bearings 3. At the same time, the rod 9 of the cooling cylinder 16 pushes the circular piston 14 downward that supplies a dose of coolant from the cooling cylinder 16, and channels 19 to the shafts 21*h*, 20*h*, and 22*h*, and into the cylinders 17 and 18, which dose returns through the channels 13 into the cylinder 16. When the operator commands to stop drilling, the system stops supplying doses of the operating fluid. This reduces the pressure of lubricant liquid, downwardly applied to the valve-plate 10, and the piston 8 returns upward to its initial position pulled up by the forces of spring 12. The discharge valve 15 outlets the lubrication liquid downward through the piston 8 at a predetermined reverse pressure, until the pressures above and under the piston 8 will be equalized. The piston 14 also returns in its initial position and stops supplying coolant into the shafts 21*h*, 20*h*, and 22*h*.

The drill bit 103 has a preferable diameter of 450 mm of the lower part thereof. It should be advantageously used for boreholes up to 12 Km deep. It can be utilized for geological and geophysical needs. The drill bit 103 is differed from the drill bit 102 in that the drill bit 103 of the third version is furnished with a cooling system supplying coolant to the hollow shafts that helps to cool down the bearings of the cutters. This allows significantly reducing the period for replacement of the shafts with the bearings and cutters, and saves maintenance expenses comparatively to the bit 102.

Another important feature of the second and third versions of drill bits is a wave-shaped profile formed by the lower contour line of the outer and inner cutters (for the second version), and of the outer, intermediate, and inner cutters (for the third version) that distinguishes them from the first version and known prior art devices. This allows essentially avoiding vibrations, and increase the rotation speed (RPM) twice, i.e. doubles the rate of drilling boreholes.

Combined Embodiments of Inventive Drill Bit

Preferred embodiments of the instant invention are best suitable for combining with the turbo-gear, designed according to U.S. patent application Ser. No. 12/291,239, that essentially recites a preferred embodiment of the turbo-gear as follows:

A device supplied with a flow of operating fluid through a non-rotatable string of pipes substantially for driving a drill bit, said device comprising: a turbo-gear having a means for assembling with said sting of pipes; the turbo-gear is supplied with a flow of operating fluid substantially for driving a drilling bit; said turbo-gear comprising: a non-rotatable casing means; an upper shaft rotatably mounted in the upper portion of said casing means, said upper shaft is coupled with blades fixedly mounted on its surface and so configured that are capable to receive pressure of said flow of operating fluid causing rotation of said upper shaft; a lower shaft rotatably mounted in the lower portion of said casing means, said lower shaft has inside a cylindrical channel made along the central axe thereof; and a number of intermediate shafts rotatably mounted in the middle portion of said casing means, disposed below said upper shaft and above said lower shaft, associated with the upper shaft, with each other, and with the lower shaft through conventional gears each having a predetermined transmission coefficient; wherein the inner space of said turbo-gear is so configured that capable to pass said flow of operating fluid therethrough; and a bushing-connector essentially shaped as a hollow cylinder having means for assembling with said turbo-gear and with said drill bit.

The meaning of the structural elements recited above is fully disclosed in the mentioned U.S. patent application Ser. No. 12/291,239. In fact, the drill bits of the first, second, and third versions of the instant application are all combinable with the aforesaid turbo-gear. FIG. 4 exemplarily illustrates a combination of the drill bit 103 with the turbo-gear 100 joined through the aforementioned bushing-connector. Alternatively, other known fasten means can be employed for such joints.

We claim:

1. A device including a drill bit, said drill bit comprising:

a predetermined number N of lug members arranged at a 360/N degree angle to each other and joined by an upper support member, each said lug member includes a lower journal portion and has a through vertical hole in an upper portion thereof;

N bearings each externally and rotatably mounted on the journal portion of each said lug member, said bearings each fixedly supports a cutter member, whose longitudinal axis is positioned at a predetermined tilt angle to a horizontal line;

a sleeve containing lubrication liquid and having a base mounted upon said upper support member and a bottom region;

a central channel disposed within the sleeve, said central channel includes a lower portion outstanding below the sleeve's base and terminated with an opening controllably closed or opened with a reciprocating valve-plate;

an annular piston capable to reciprocate in the bottom region of the sleeve, snug-fitting between the sidewalls of said sleeve and said channel, said piston is furnished with at least one discharge valve outletting the lubrication liquid through said piston at a predetermined reverse pressure;

a spring disposed at the bottom region of said sleeve below said piston;

N rods mounted in the bottom region of said sleeve and inserted through the holes of said lug members, the upper ends of said rods are coupled to said piston, and the lower ends of said rods are coupled to said valve-plate; and lubrication channels arranged in said lug members and communicating the bottom region of said sleeve under the piston with said bearings.

2. The device according to claim 1, wherein N is equal to three.

3. The device according to claim 1 further including a gear means substantially connected to said drill bit.

4. The device according to claim 3, wherein said gear means is associated with said upper support member of said drill bit via means for fastening.

* * * * *